US006955497B2

(12) United States Patent
Snagel et al.

(10) Patent No.: US 6,955,497 B2
(45) Date of Patent: Oct. 18, 2005

(54) PAVEMENT MARKER

(75) Inventors: Paul Snagel, Chicago, IL (US); Swanand Sardesai, Forest Park, IL (US); David Langlands, Mount Prospect, IL (US); Jeffrey A. Tidaback, Arlington Heights, IL (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/442,336

(22) Filed: May 21, 2003

(65) Prior Publication Data

US 2004/0234335 A1 Nov. 25, 2004

(51) Int. Cl.[7] ..... E01F 11/00
(52) U.S. Cl. ..... 404/15
(58) Field of Search ..... 404/12, 15, 16, 404/34; 52/390; D25/110, 140; D10/113

(56) References Cited

U.S. PATENT DOCUMENTS

| | | | | | |
|---|---|---|---|---|---|
| 2,255,712 | A | * | 9/1941 | Phillips | 52/390 |
| 2,666,373 | A | * | 1/1954 | Mattson | 404/16 |
| 4,694,627 | A | * | 9/1987 | Omholt | 52/390 |
| 4,731,140 | A | * | 3/1988 | Yontrarak | 156/154 |
| 4,815,890 | A | | 3/1989 | Duncan | |
| 5,327,850 | A | | 7/1994 | Sly et al. | |
| 5,857,802 | A | * | 1/1999 | Richter | 404/14 |
| 5,908,262 | A | | 6/1999 | Ahn | |
| 6,059,488 | A | * | 5/2000 | Green | 404/12 |
| D427,103 | S | * | 6/2000 | Bryant, Jr. | D10/113 |
| 6,079,899 | A | * | 6/2000 | Green | 404/12 |
| 6,126,360 | A | * | 10/2000 | May et al. | 404/14 |
| 6,579,036 | B2 | * | 6/2003 | Attar | 404/16 |

FOREIGN PATENT DOCUMENTS

| | | | |
|---|---|---|---|
| DE | 28 19 006 | | 7/1979 |
| WO | 96/26323 | * | 8/1996 |
| WO | 96/36770 | * | 11/1996 |

* cited by examiner

*Primary Examiner*—Gary S. Hartmann
(74) *Attorney, Agent, or Firm*—Gerald E. Hespos; Anthony J. Casella

(57) ABSTRACT

A surface-mounted pavement marker is provided for secure attachment to a pavement surface by adhesive. The bottom surface of the pavement marker is divided into sectors, and a parallel array of grooves is formed in each sector. The grooves in each array are angularly aligned to the grooves in adjacent arrays. Additionally, each groove extends continuously from its inner end to the outer periphery of the pavement marker.

7 Claims, 4 Drawing Sheets

PAVEMENT MARKER

BACKGROUND OF THE INVENTION

1. Field of the Invention

The invention relates to a pavement marker that reflects and/or transmits light for identifying selected regions of a driving surface.

2. Description of the Related Art

Pavement markers are secured on or in a pavement surface to help direct drivers along preferred travel lanes. For example, pavement markers often are mounted at selected intervals along the lane lines. The pavement marker includes a light reflective or light transmissive surface aligned to be readily apparent to a driver approaching the pavement marker. For example, the light reflective or light transmissive material in the pavement marker may be constructed to reflect or transmit ambient light toward the driver or to reflect headlights back toward the driver.

Pavement markers used in colder climates typically must be embedded at least partly into the pavement surface in view of the likely contact with a snow plow. Pavement markers used in warmer climates or on pavement surfaces where snow plow activity is not anticipated may be mounted on the surface of the pavement. Surface mounted pavement markers are substantially less expensive than pavement markers that must be embedded in the roadway surface and are much easier and less expensive to install. Hence, surface mounted pavement markers are preferred in situations where permitted by climate and roadway conditions.

Surface-mounted pavement markers frequently are struck by vehicular tires while the vehicle is traveling along the lane line or crossing the lane line at an angle that typically is less than 3°. The impact of tires moving over a pavement marker creates bending stresses and stress concentrations. Hence, the pavement marker must be sufficiently strong to maintain structural integrity in response to the frequent impact by vehicular tires.

Surface-mounted pavement markers also should be constructed to remain in a substantially fixed position on the surface of the pavement. In this regard, surface-mounted pavement markers typically are secured to the surface of the pavement by an adhesive. The adhesive must secure itself to both the pavement and to the pavement marker with sufficient force to resist movement in response to the impact imposed by vehicular tires. The adhesive used to affix a surface-mounted pavement marker typically is bitumen, which is a petroleum based product similar to the petroleum based products in the pavement. Bitumen never permanently hardens, and is subject to deformation, yielding and sheer, particularly in the warm weather environments in which surface-mounted pavement markers are most prevalent.

The strength of the attachment provided by the adhesive is affected largely by the surface area of contact between the adhesive and the pavement marker and to a lesser extent by the mechanical grip achieved by the adhesive. The strength of attachment attributable to the surface area of contact often is referred to as a chemical bond or a wetting parameter. The extent of the surface-to-surface contact between the adhesive and the pavement marker can be increased by providing a non-smooth bottom surface for the pavement marker. For example, pavement markers have been formed with an array of grooves in the bottom surface. Typically the grooves all are parallel to one another and are oriented to be substantially perpendicular to the lane lines. The adhesive applied to the roadway surface fills in the parallel grooves and increases the surface area of attachment between the adhesive and the pavement marker. Additionally, grooves aligned perpendicular to the lane lines provide some minor mechanical gripping that resists forces generated in response to impact by tires. However, grooves aligned perpendicular to the lane lines are not as effective in resisting bending stresses and stress concentrations created by the impact of tires. In this regard, the parallel grooves in the bottom surface of the pavement marker increases the potential for splitting the pavement marker along the parallel grooves in response to a load placed on the top surface of the pavement marker, such as a load attributable to the tire of a vehicle. A pavement marker that was reoriented so that the groves were aligned parallel to the lane lines or at an acute angle to the lane lines would maintain a desirably large surface area of contact and might reduce the chance of breakage due to a load applied to the top surface of the pavement marker. However, the retention attributable to the mechanical gripping of the adhesive would be reduced as compared to a pavement marker where the parallel continuous grooves were aligned perpendicular to the lane lines.

Other pavement markers have been molded to include an upper shell with a concave lower surface. The upper shell is inverted, and the concave interior of the pavement marker is filled with an epoxy potting material to a depth that generally conforms to the periphery of the bottom edge of the shell. Sand is embedded partly in the potting material so that the potting material exhibits a uniform roughness after curing. The cured potting material is retained securely in the shell and defines a hard substantially planar abrasive surface. The pavement marker with the cured potting material therein can be applied bottom-surface down onto the adhesive. The overall roughening achieved by the sand partly embedded in the surface of the potting material increases the surface area. The larger surface area improves the chemical bonding between the adhesive and the pavement marker in much the same way as the parallel grooves described above. Additionally, an enhanced mechanical gripping is provided between the adhesive and the leading edges of each grain of sand. Pavement markers of this type work well. However, the filling of the potting material into the inverted shell of the pavement marker and the need to cure the potting material adds significantly to the manufacturing time and cost. The finished pavement marker also is relatively heavy and hence contributes to shipping costs.

Some pavement markers include bottom surfaces with a circular array of grooves or with an array of discontinuous grooves that generally define a waffle pattern of recesses. The inventor herein has concluded that such designs trap air during the installation of the pavement marker, and hence minimize the area of engagement between the pavement marker and the adhesive. The reduction in the areas of engagement substantially reduce the ability of the adhesive to hold the pavement marker in place.

In view of the above, it is an object of the subject invention to provide a surface-mounted pavement marker with a bottom surface configured for secure retention on the surface of the pavement.

SUMMARY OF THE INVENTION

The invention is directed to a pavement marker having a body with a bottom surface and a top surface. The top surface may define a continuous arcuate surface extending up from the bottom surface, and hence may be a chordal section of a sphere or an elliptoid. Alternatively, the top may comprise a well defined top surface that extends substantially parallel to the bottom surface and at least one converging side surface extending between the top and bottom surfaces. The side surfaces may be planar, arcuately generated or a combination of planar and arcuate surfaces.

The pavement marker may further include at least one optical signal generator. The optical signal generator may be formed from a material that is light transmissive and/or light reflective. The optical signal generator is disposed, aligned and configured to redirect light from a light source in a range of directions that will be visually observed by an oncoming driver. The light source may be ambient light or light from the headlights of the vehicle. The optical signal generator may be formed unitarily with the body of the pavement marker. However, in a preferred embodiment, the optical signal generator is mounted in at least one recess formed in at least one side wall of the body. A preferred optical signal generator is a retroflecting lens array.

The body of the pavement marker preferably is molded from a thermoplastic material and preferably is of unitary construction. Thermoplastic products generally can be manufactured with greater dimensional accuracy if the walls of the product are of substantially uniform thickness. Accordingly, the body of the pavement marker is molded to define a unitary three-dimensional matrix of thermoplastic material with unitarily joined walls separated by coring holes. A plurality of the coring holes may extend up from the bottom surface.

The bottom surface of the body is substantially planar and may be interrupted by an array of coring holes provided for molding accuracy and efficiency. However, the generally planar bottom surface of the body is molded to define a plurality of grooves. The grooves are not all parallel and preferably all of the grooves extend continuously to the outer periphery of the bottom wall. More particularly, the bottom surface of the main body may be divided into a plurality of adjacent sectors that may meet one another at a generally central portion of the body. The grooves in each sector are aligned to extend at an angle to the grooves in the adjacent sectors. Additionally, the grooves in each sector are aligned to extend continuously from an inner location on the respective sector to the outer periphery of the bottom surface. Thus, each groove effectively defines a continuous channel that extends from an interior position on the bottom surface to the outer periphery of the bottom surface. Alternatively, the grooves may define an array of radii extending from a center point on the bottom surface to the outer periphery. Each groove may define a V-shaped recess, and the grooves may be disposed sufficiently close to one another to define V-shaped ridges between adjacent grooves. The grooves preferably extend across any coring holes that may be formed in the bottom surface for molding efficiency.

In an alternate embodiment, portions of the bottom surface with coring holes may be recessed. The pavement marker may then include a bottom cover secured in the recess. The bottom cover includes a bottom surface molded or otherwise formed with grooves disposed to substantially align with the grooves formed in peripheral regions of the bottom surface. The bottom cover effectively covers the coring holes. Hence, the total grooved surface area on the bottom surface of the body can be increased significantly without affecting molding efficiency. The bottom cover may be substantially coplanar with peripheral regions of the bottom surface of the body. Alternatively, the bottom cover may be recessed slightly to define an additional surface discontinuity in the bottom surface. The recess of the bottom cover may be slight and is selected so that the peaks of the ridges formed in the bottom cover are not below a plane defined by the bottoms of the grooves in peripheral regions of the bottom surface.

The groove arrays formed in the bottom surface of the pavement marker provide an increased surface area, an improved wetting parameter and very effective gripping of the bitumen or other adhesive used to secure the pavement marker. Additionally, the grooves in each array extend continuously to the outer periphery of the pavement marker. Hence, the grooves do not create air pockets that reduce engagement areas between the bitumen or other adhesive and the pavement marker. Additionally, the non-parallel alignment of the grooves across the bottom surface avoids stress concentrations attributable to loads applied to the top surface due to the impact of tires on the top surface.

DETAILED DESCRIPTION OF THE PREFERRED EMBODIMENTS

Figure 1:
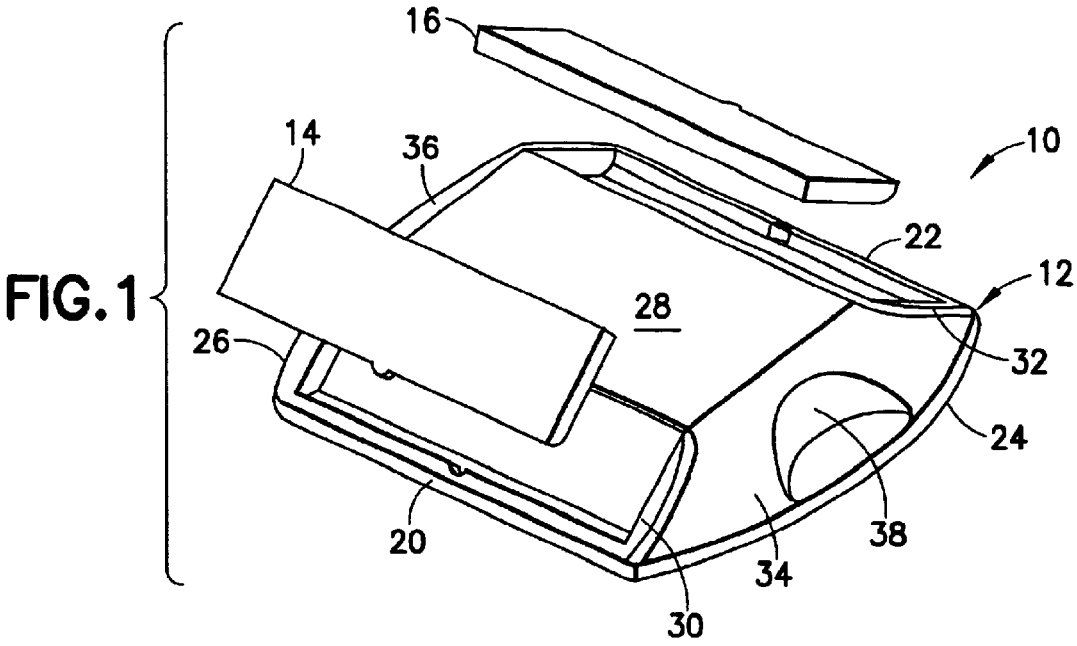
FIG. 1 is an exploded perspective view of a pavement marker in accordance with the subject invention.
Figure 2:
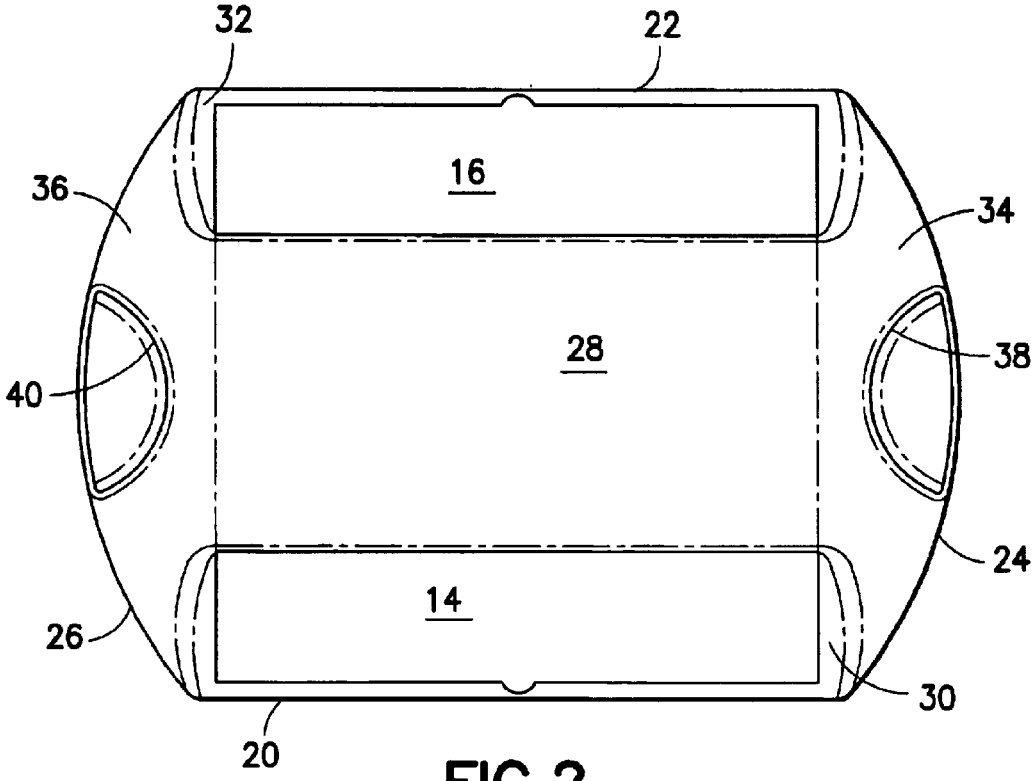
FIG. 2 is a top plan view of the pavement marker shown in FIG. 1.
Figure 4:
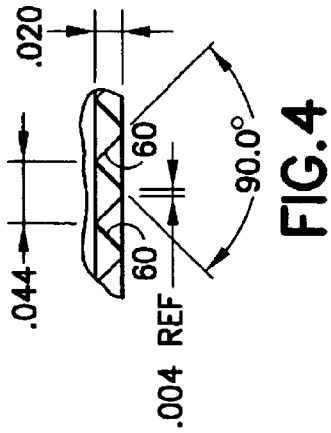
FIG. 4 is a cross-sectional view of the body taken along line 445 in FIG. 3.

A pavement marker in accordance with a first embodiment of the subject invention is identified generally by the numeral 10 in FIGS. 1–4. The pavement marker 10 includes a body 12 and first and second retroreflective lens arrays 14 and 16 respectively. The retroreflective lens arrays may be generally of the type incorporated into pavement markers sold by Avery Dennison. The retroreflective lens arrays 14 and 16 may be secured to the body 12 by adhesives, welding, heat staking or other known attachment means.

The body 12 is molded unitarily from a thermoplastic material and includes a generally oblong bottom surface 18 with parallel front and rear edges 20 and 22 and first and second arcuate side edges 24 and 26 that extend between the front and rear edges 20 and 22. The side edges 24 and 26 are convex and generally elliptical. The body 12 further includes a top surface 28 opposite from the bottom surface 18. The top surface 28 is generally rectangular, generally planar and approximately parallel to the bottom surface 18. However, other configurations for the top surface can be provided, such as a cylindrical or some other convex arcuate configuration. The top surface 28 defines an area substantially smaller than the bottom surface 18 and preferably less than half the area of the bottom surface 18. Front and rear surfaces 30 and 32 extend respectively from the front and rear edges 20 and 22 of the bottom surface 18 to the top surface 28 and converge toward one another. First and second arcuate side surfaces 34 and 36 extend respectively from the first and second side edges 24 and 26 of the bottom surface 18 to the top surface 28. Intersections between the top surface 28 and the first and second side surfaces 34 and 36 are smoothly arcuate. The first and second side surfaces 34 and 36 are characterized by concave depressions 38 and 40 respectively. The depressions 38 and 40 define convenient finger gripping regions and also help to achieve uniform wall thicknesses for all regions of the body 12 to achieve molding efficiencies as explained herein.

The front and rear surfaces 30 and 32 are recessed relative to the top surface 28 and the side surfaces 34 and 36. Thus, upper surfaces of the webs 44 define supports to which the retroreflective lens arrays 14 and 16 can be adhered, welded or otherwise secured.

The bottom surface 18 of the body 12 is characterized by a central array of coring holes 46 separated from one another by webs 48. The coring holes 46 in the central array are substantially opposite the top surface 28 and terminate short of the top surface 28 by a distance approximately equal to the thickness of the webs 48 and the webs 44. Similarly, arrays of side coring holes 52 and 54 extend into portions of the bottom surface 18 aligned respectively with the side surfaces 34 and 36 of the body 12. The side coring holes 52 and 54 are separated from one another by webs 56 and 58. The coring holes 52 and 54 terminate short of the side surfaces 34 and 36 by distances approximately equal to the thickness of the webs 48, 56 and 58. Additionally, the coring holes 54 and 56 are spaced from the depressions 38 and 40 by substantially the thickness of the webs 48, 56 and 58. Hence, the body 12 has substantially uniformly thick walls throughout and can be molded efficiently without sink marks, short shots or the like.

Figure 3:
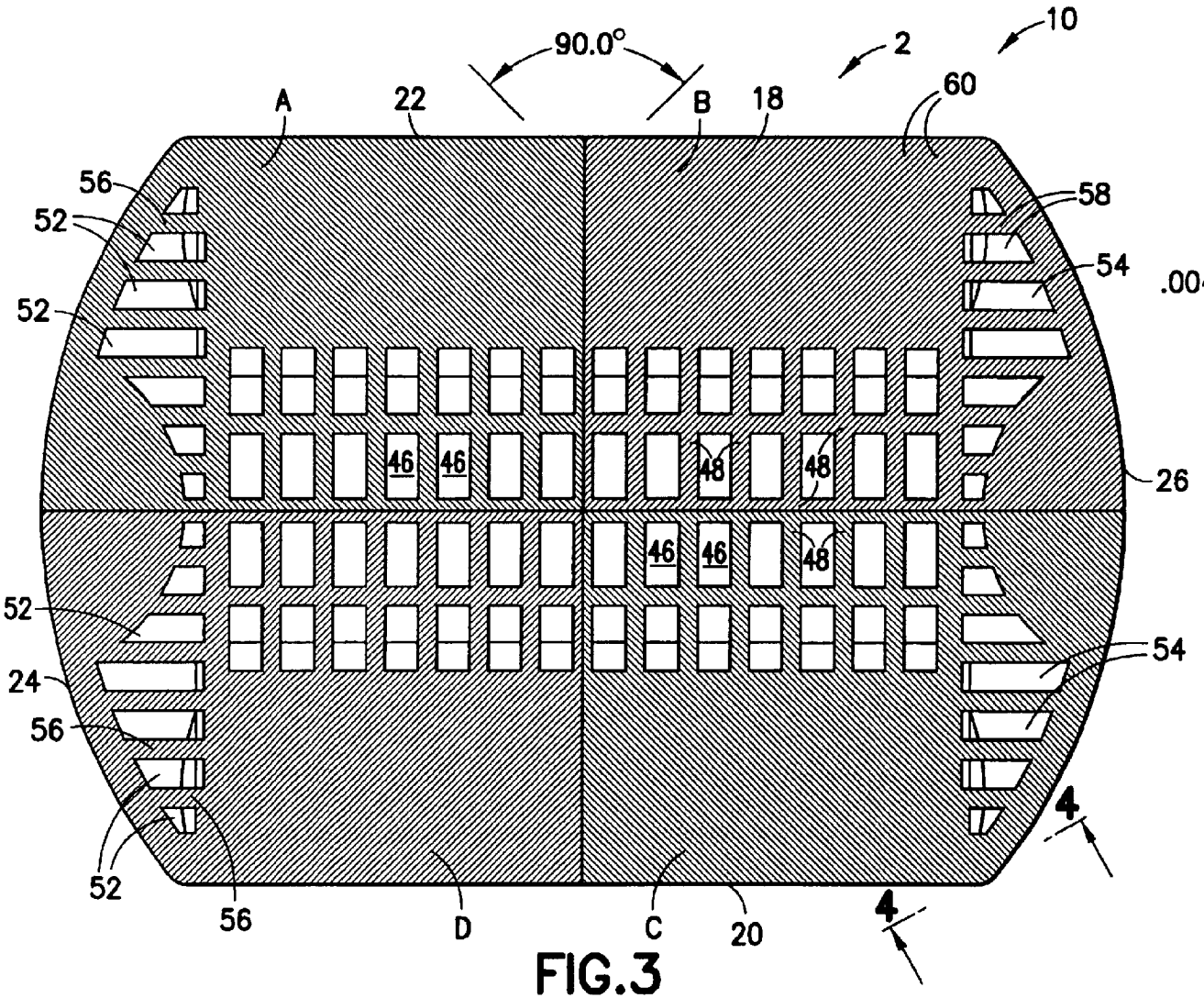
FIG. 3 is a bottom plan view of the pavement marker.
Figure 5:
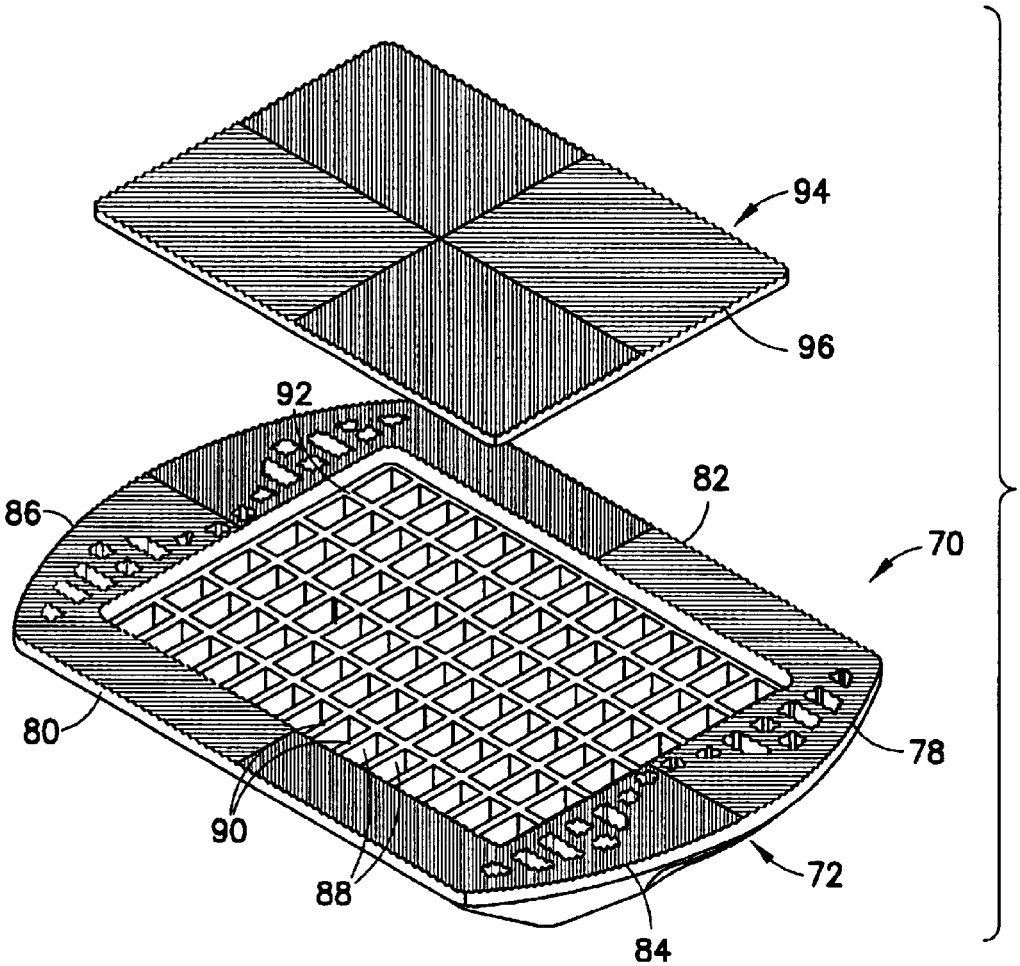
FIG. 5 is an exploded bottom perspective view of an alternate pavement marker.

The bottom surface 18, as shown in FIG. 3, is divided into four quadrants A, B, C and D. The quadrants meet at a location midway between the front and rear edges 20 and 22 and midway between the first and second side edges 24 and 26. Each quadrant A, B, C and D is characterized by an array of substantially parallel grooves 60 that extend out from the intersection of the respective quadrant with adjacent quadrants. The grooves 60 then extend to the outer periphery defined by the edges 20–24. Thus, each groove 60 defines a continuous channel that extends along the respective quadrant A, B, C or D to the outer periphery of the bottom surface 18. Some of the grooves 60 are interrupted by coring holes 46, 52 or 54, but none of the grooves 60 are interrupted by a ridge or any structure that would impede the flow of air along the groove 60. As shown in FIG. 5, each groove 60 is defined by two substantially planar surfaces that intersect at 90°, and hence each groove 60 is of substantially V-shaped cross-section. Additionally, the grooves 60 are sufficiently close together (i.e., about 0.044 inch) to define ridges 62 of substantially inverted V-shape. Furthermore, each groove 60 is about 0.020 inch deep.

The pavement marker 10 is installed in substantially a conventional manner by applying bitumen or other adhesive to a pavement surface. The installer then may grip the body 12 of the pavement marker 10 by the depressions 38 and 40 in the side surfaces 34 and 36. The bottom surface 18 then is pressed down into the bitumen or other adhesive on the pavement surface so that the front and rear edges 20 and 22 are perpendicular to the lane lines. The grooves 60 all define continuous channels that extend from interior locations of the respective quadrants A, B, C and D to outer peripheral locations on the bottom surface 18. Hence, air can be urged outwardly through the grooves 60 to ensure large areas of surface-to-surface contact between the bitumen or other adhesive and the bottom surface 18 of the pavement maker 10.

The pavement marker 10 will be subjected to impact with tires frequently during use. Most of this impact will be within two or three degrees of being parallel to the lane lines. The grooves 60 in the bottom surface 18 are arranged at a plurality of different angles oblique to the lane lines, and hence at a plurality of different angles to the direction of impact of the tires on the pavement marker 10. Accordingly, the pavement marker 10 is not likely to create stress concentrations and will resist breakage in response to loads applied by the tires impacting on the pavement marker.

The pattern of grooves 60 in the bottom surface 18 of the pavement marker 10 also is highly resistant to lateral shifting of the pavement marker. In particular, the pattern of grooves 60 provides a large surface area, and hence a strong chemical bonding or wetting parameter at least equal to the chemical bonding achieved by prior art pavement markers with a single array of parallel grooves. Additionally, the plurality of different angles for the grooves 60 provides greater mechanical gripping regardless of the direction of the impact imposed on the pavement marker by tires. Furthermore, resistance to lateral displacement also is greater than in pavement markers that have a honeycomb pattern, a waffle pattern or any other pattern of discontinuous surface irregularities. In this regard, discontinuous surface patterns tend to trap air during installation and will achieve a substantially lower surface-to-surface contact between the adhesive and the pavement marker. In contrast, substantially all of the grooves 60 extend continuously to the outer periphery of the bottom surface and hence define channels for the escape of air. Still further, the well defined surface regions formed by the grooves 60 achieve better surface-to-surface contact with the adhesive than can be achieved with a generally roughening disposed on the bottom surface 18.

Figure 6:
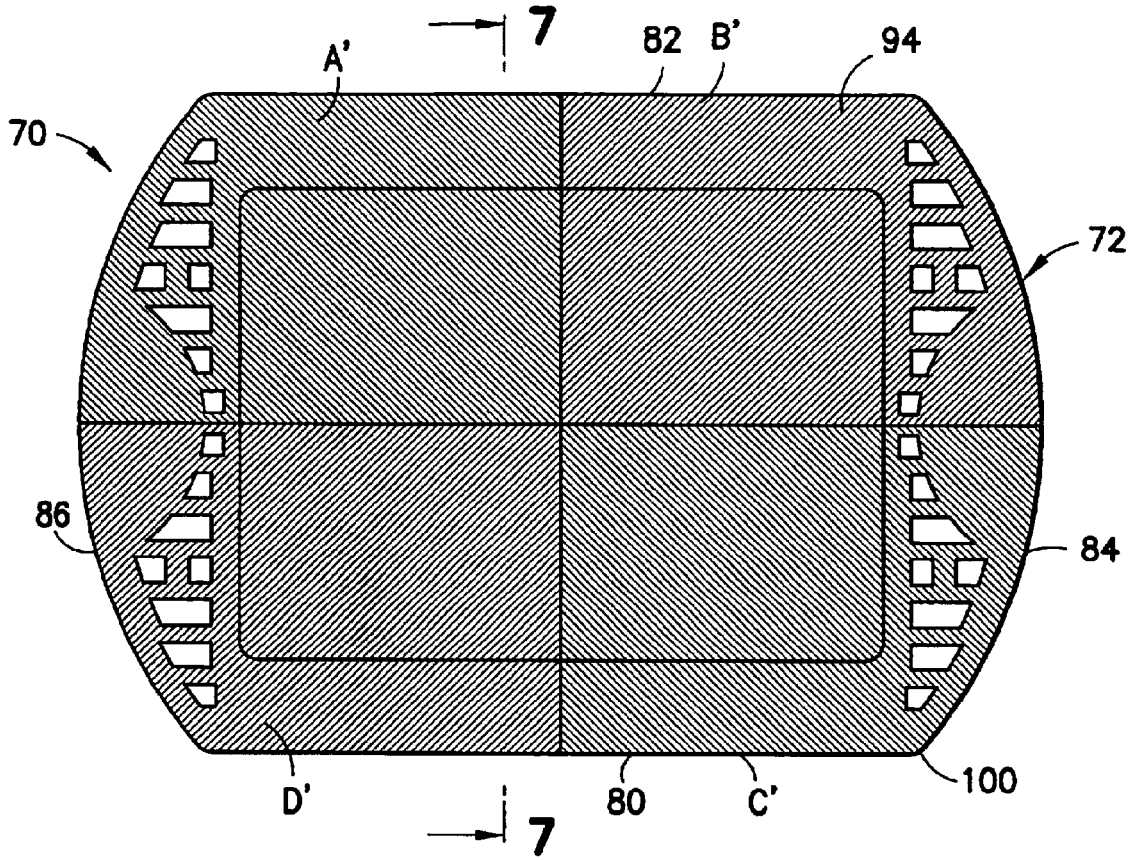
FIG. 6 is a bottom plan view of the alternate pavement marker.
Figure 7:
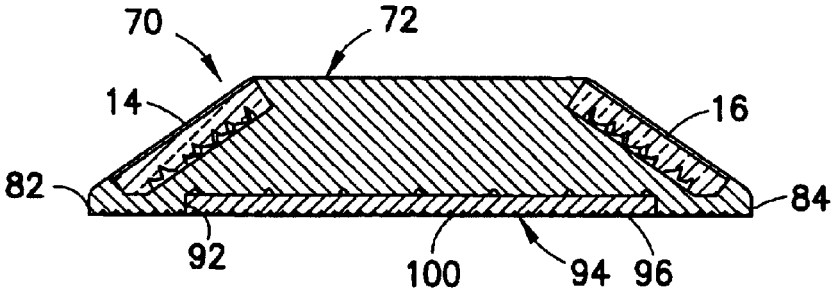
FIG. 7 is a cross-sectional view taken along line 7—7 in FIG. 6.

An alternate embodiment of the pavement marker is identified by the numeral 70 in FIGS. 5–7. The pavement marker 70 includes a body 72 that is very similar to the body 12 of the pavement marker 10 described and illustrated above. Additionally, the pavement marker 70 includes retroreflective lens arrays that are identical to the retroreflective lens arrays 14 and 16 in the pavement marker 10.

The body 72 has a bottom surface 78 that differs from the bottom surface 18 of the body 12. More particularly, the bottom surface 78 includes front and rear edges 80 and 82 and first and second side edges 84 and 86. At least portions of the bottom surface 78 opposed to the top surface of the body 72 are formed with an array of central coring holes 88 that are separated from one another by webs 90. Bottom surfaces of the webs 90 define a plane that is recessed from a plane defined by the edges 80, 82, 84 and 86. Hence, the bottom surface 78 of the body 72 defines a substantially rectangular central recess 92. The pavement marker 70 further includes a bottom cover 94. The bottom cover 94 is substantially rectangular and substantially planar and is secured in the recess 92 in the bottom surface 78. The bottom cover 94 may be adhered to the bottom surfaces of the respective webs 90 that define the recesses 92. Alternatively, the bottom cover 94 may be welded or otherwise secured to the webs 90. The bottom surface 96 of the bottom cover 94 may be substantially planar with the bottom surface 78 of the body 72. Alternatively, the bottom surface of the bottom cover 94 may be offset upwardly a slight distance from the bottom surface 78 of the body 72.

The bottom of the pavement marker 70 is divided into quadrants A', B', C' and D' as shown in FIG. 6. Additionally, the bottom surface 78 of the body 72 and the bottom surface 96 of the bottom cover 94 are formed with grooves 100. The grooves 100 are arranged substantially as the grooves 60 on the pavement marker 10 described and illustrated above. Additionally, the grooves 100 formed on the cover 94 are disposed to be substantially continuous with the grooves 102 formed on the bottom surface 78. Hence, the grooves 100 on the bottom surface of the pavement marker 70 achieve substantially the same advantages as the grooves 60 on the pavement marker 10. However, the bottom cover 94 covers the recesses 88 in the bottom surface 78 of the body 72. Thus, the bottom surface 78, 96 of the pavement marker 70 has a much larger surface area than the bottom surface 18 of the pavement marker 10 and accordingly achieves a larger surface-to-surface contact between the adhesive and the pavement marker 70. Additionally, the cover 94 may be offset upwardly from the bottom surface 78 of the body 72 to define a minor step around the periphery of the central recess 92. This step provides another area of surface contact. However, the height of the step should not exceed the depth of the grooves 100. With these relative dimensions, continuous channels for the escape of air are assured.

While the invention has been described with respect to certain preferred embodiments, it is apparent that various changes can be made without departing from the scope of the invention. For example, the illustrated embodiment shows a bottom surface with four quadrants. However, more or fewer sections can be provided with grooves extending out to the periphery and being angularly aligned to one another. For example the grooves may define radii. Additionally, the body of the pavement marker need not be oblong, and can assume other shapes, such as square or circular. Still further, the pavement marker may not require retroreflectors on both the front and rear surfaces, and a reflector on only one of the surfaces may be sufficient.

What is claimed is:

1. A pavement marker having a bottom surface with an outer periphery, lateral external surfaces extending up from the bottom surface at the outer periphery of the bottom surface, said bottom surface being divided into a plurality of sectors, each said sector being formed with an array of V-shaped grooves extending substantially parallel to one another and substantially continuously from an inner position on the sector to intersect one of said lateral external surfaces of the pavement marker at the outer periphery of the bottom surface, each said groove being defined by surfaces meeting at lines substantially parallel to the bottom surface, the grooves in each sector of the bottom surface being angularly aligned to intersect the grooves in each adjacent sector, whereby air can be urged outwardly through the grooves to the lateral external surfaces when the bottom surface of the pavement marker is placed on a pavement surface.

2. The pavement marker of claim 1, wherein the grooves in each sector are spaced from one another to define ridges having a substantially V-shape, the ridges lying in a plane defining the bottom surface.

3. The pavement marker of claim 1, wherein the bottom surface has four sectors meeting in a central position on the bottom surface of the pavement marker.

4. The pavement marker of claim 3, wherein the grooves in each sector are substantially perpendicular to the grooves in each sector adjacent thereto.

5. The pavement marker of claim 1, wherein the bottom surface is characterized by a plurality of coring holes interrupting at least certain of the grooves.

6. A pavement marker having a bottom surface with an outer periphery, said bottom surface being divided into a plurality of sectors, each said sector being formed with an array of grooves extending substantially continuously from an inner position on the sector to the outer periphery of the bottom surface, the grooves in each sector of the bottom surface being angularly aligned to the grooves in each adjacent sector, a central portion of the bottom surface being formed with a plurality of coring holes separated from one another by webs, the webs being offset upwardly from the bottom surface, the pavement marker further including a bottom cover secured to the webs adjacent the coring holes in the bottom surface, the grooves in the bottom surface being formed on the cover and on portions of the bottom surface surrounding the cover.

7. The pavement marker of claim 6, wherein the bottom cover has a bottom surface offset said upwardly from portions of the bottom surface surrounding the bottom cover, the offset of the bottom cover being less than a depth defined by each of said grooves.

* * * * *